United States Patent [19]

McLane et al.

[11] Patent Number: 4,509,581

[45] Date of Patent: Apr. 9, 1985

[54] MACHINE FOR CONTINUOUSLY CASTING BATTERY GRIDS

[75] Inventors: Jack E. McLane; Raymond L. Schenk; Robert R. Rader; John W. Wirtz, all of Port Huron, Mich.

[73] Assignee: Wirtz Manufacturing Company, Inc., Port Huron, Mich.

[21] Appl. No.: 517,668

[22] Filed: Jul. 27, 1983

Related U.S. Application Data

[62] Division of Ser. No. 380,056, May 20, 1982, Pat. No. 4,415,016.

[51] Int. Cl.[3] ..... B22D 11/10

[52] U.S. Cl. ..... 164/479; 164/429; 164/133

[58] Field of Search ..... 164/479, 429, 439, DIG. 1, 164/133, 337

[56] References Cited

U.S. PATENT DOCUMENTS 4,349,067 9/1982 Wirtz et al. ..... 164/479

*Primary Examiner*—Kuang Y. Lin

*Attorney, Agent, or Firm*—Barnes, Kisselle, Raisch, Choate, Whittemore & Hulbert

[57] ABSTRACT

A machine for casting battery grids in a continuous manner includes a rotary cylindrical drum in the outer peripheral surface of which the battery grid pattern is machined as a cavity. A shoe is arranged against an arcuate segment of the peripheral surface of the drum. An orifice slot in the shoe has an opening at the peripheral surface of the drum. Molten lead under superatmospheric pressure is directed into the orifice slot in an amount in excess of that required to fill the grid cavity on the drum through the opening in the orifice slot as the drum rotates. Means are provided in the shoe for maintaining the molten lead in the orifice slot in a highly fluid condition and for causing the lead filling the grid cavity to solidify rapidly as it advanced beyond the opening of the orifice slot.

14 Claims, 23 Drawing Figures

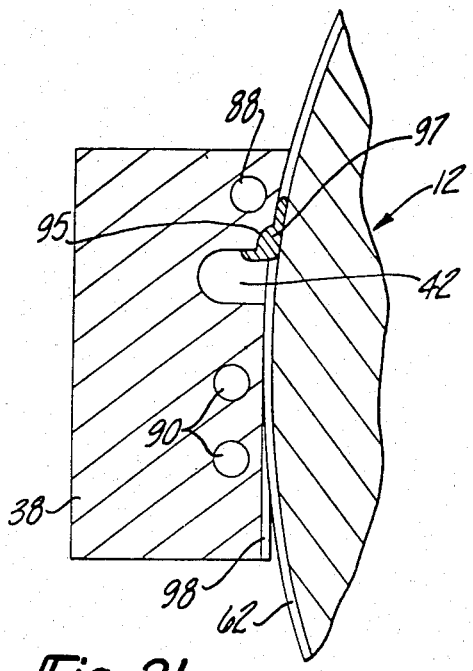
Fig-21
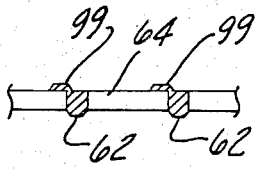
Fig-22
Fig-18
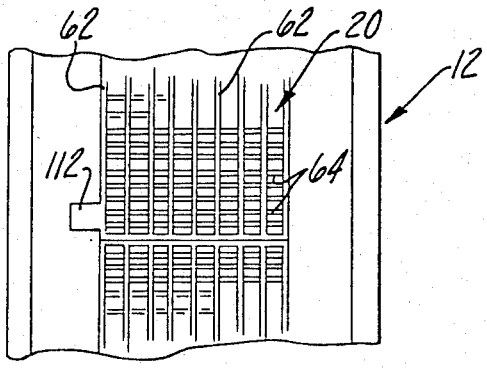
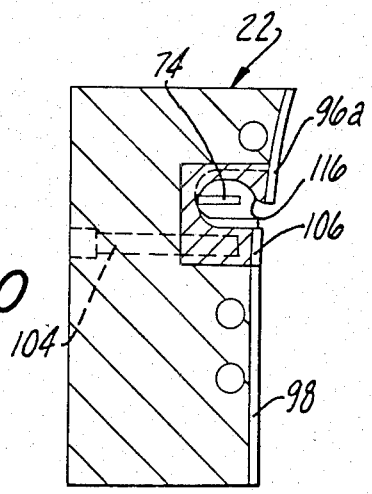
Fig-20
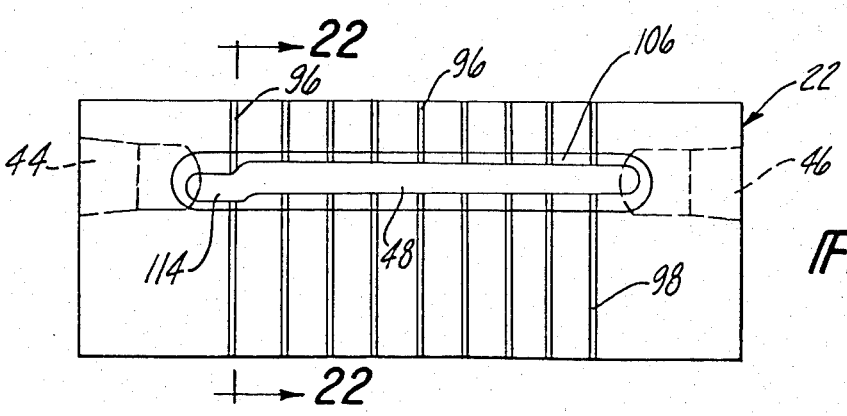
Fig-19

MACHINE FOR CONTINUOUSLY CASTING BATTERY GRIDS

This is a division of application Ser. No. 06/380,056, filed May 20, 1982 now U.S. Pat. No. 4,415,016.

This invention relates to a machine and method for continuously casting battery grids.

In application Ser. No. 176,479, filed Aug. 8, 1980, now U.S. Pat. No. 4,349,067, and owned by the assignee of this application, there is disclosed a machine for casting battery grids in a continuous manner. The prior machine generally consists of a rotary cast iron drum having the desired battery grid pattern formed on the outer peripheral surface of the drum by a plurality of circumferentially and transversely extending grooves. The grooves intersect to form raised pads on the surface of the drum which, in the finished battery grid, define the spaces between the vertical and transverse wires of the grid. A shoe formed of a highly conductive material, such as aluminum-bronze, is positioned against an arcuate segment of the drum in close fitting relation. The shoe has an orifice slot therein that is open at the face of the drum. An inlet at one end of the orifice slot connects with a stream of pressurized molten lead from a lead pot. The outlet of the orifice slot is connected to a return line which extends back to the lead pot. Molten lead is directed to the orifice slot in an amount greater than necessary to fill the grooves grid cavity rotating past the orifice slot and the excess molten lead is directed back to the lead pot through the discharge line. The molten lead in the orifice slot is maintained under superatmospheric pressure by any suitable means.

While the above described machine produces satisfactory battery grids when operated under carefully controlled conditions, particularly when the temperature of various components of the machine are maintained within selected narrow ranges, problems have been encountered when attempting to consistently produce grids of the highest quality at a high rate of production over a long period of continuous operation. Some of the problems encountered with the prior machine when operated on prolonged continuous production runs have been flashing of lead between the wires of the grid, lack of complete fill of the grid cavity, and seams in the grid wires and at the junction of the grid lug and the adjacent wires of the grid. These problems result largely from the inability to maintain the various components of the machine within very narrow ranges of temperature for prolonged periods of time.

It is believed that the necessity for narrow temperature ranges required for satisfactory operation of the prior machine is attributable largely to the design and construction of the shoe. With the design of shoe utilized in the prior machine, if the temperature of the molten lead in the orifice slot exceeds certain narrow limits, there is a tendency for the lead to become partially solidified against the outer periphery of the drum within the area of the opening in the orifice slot. As the drum rotates this partially solidified lead accumulates as sludge along the downstream side of the orifice slot opening and can eventually cause bridging of the lead across the opening. When this occurs, the grooves underlying the bridged portion of the slot can only be supplied with lead from each side of the bridged section through the transversely extending grooves. This produces incomplete filling of the grooves as well as knitted joints in the wire as distinguished from homogeneous fused joints. These knitted joints not only produce grids of poor structural qualities, but also reduce the current carrying capacity of the grid.

The primary object of the present invention resides in the provision of a battery grid casting machine and a method which avoids the problems encountered with the prior machine and, more specifically, the provision of a machine and method for continuously casting battery grids of consistently high quality at a high rate of production and over a prolonged period of continuous operation.

Another object of this invention is to provide a shoe for a machine of the type described which enables operation of the machine over a prolonged period of time within a temperature range which is substantially wider than required in the operation of the prior machine.

A more specific object of this invention is to provide a shoe for a machine of the type described that is designed and constructed such that the temperature of the molten lead throughout the extent of the orifice slot tends to remain substantially uniform for prolonged periods of operation.

A further object of this invention is to utilize a wear-resistent insert embedded in the shoe which forms a heat barrier between the lead in the orifice slot and the adjacent portions of the shoe.

A further object of the present invention is to provide a shoe for a battery casting machine wherein the lead is caused to flow between the inlet and the outlet of an orifice slot in an undulating path so as to avoid lamellar flow in the orifice slot and thus minimize the tendency for the lead to solidify against the pads and within the grooves on the drum in the area of the orifice slot.

In accordance with the present invention the desired high temperature and therefore the high degree of fluidity of the molten lead throughout the extent of the orifice slot is maintained primarily by causing it to flow from the inlet to the outlet of the orifice slot in an undulating path at the peripheral surface of the drum. This tends to prevent solidification of the lead against the portion of the lower temperature drum which is in registration with the opening of the orifice slot. When the lead in the area of theorifice slot opening is prevented from solidifying, it reduces the tendency for the lead to bridge across the opening and thus enhances the ability of the grooves in the drum to be filled with molten lead directly from the overlying portions of the orifice slot.

Other objects, features and advantages of the present invention will become apparent from the following description and accompanying drawings, in which.

Figure 12:
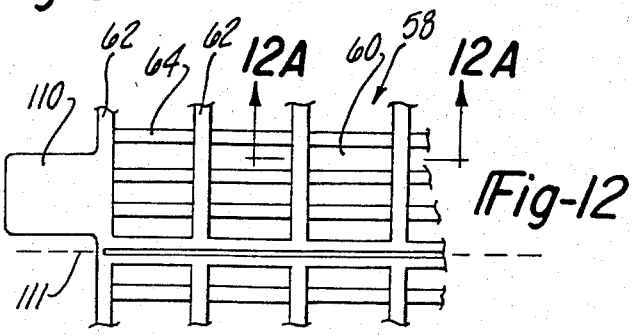
FIG. 12 is a fragmentary plan view of two connected battery grids cast on the machine prior to separation into individual grids.
Figure 12A:
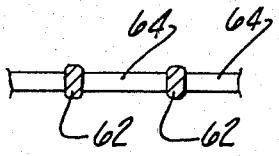
Figure 13:
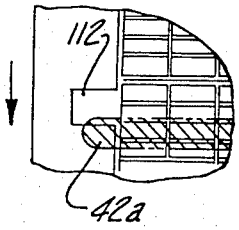
Fig-13 PRIOR ART
Figure 14:
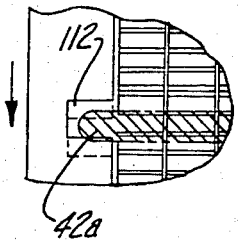
Fig-14 PRIOR ART
Figure 15:
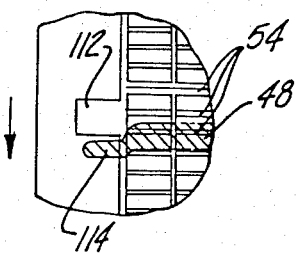
Figure 16:
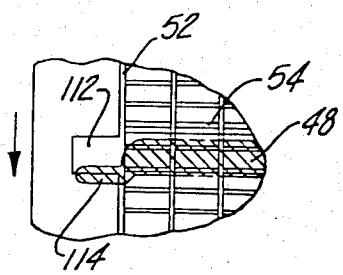
Figure 17:
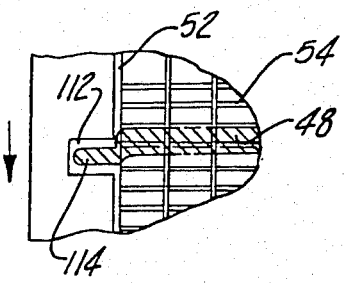

FIG. 12*a* is a sectional view along the line 12*a*–12*a* in FIG. 12;

FIGS. 13 and 14 are fragmentary views illustrating schematically the manner in which molten lead flows into the lug cavity and the adjacent wire grooves in a drum with a shoe constructed in accordance with the prior art;

FIGS. 15, 16 and 17 are fragmentary views illustrating schematically the manner in which molten lead flows into the lug cavity and the adjacent wire grooves from a shoe constructed in accordance with the present invention;

FIG. 18 is a fragmentary plan view of the peripheral surface of the drum;

FIG. 19 is a plan view of a shoe of modified construction;

FIG. 20 is a sectional view along the line 20—20 in FIG. 19;

FIG. 21 is a fragmentary sectional view of another shoe of modified construction; and FIG. 22 is a view similar to FIG. 12*a* and showing the cross section of a grid produced when grooves in the shoe are offset slightly from the circumferential grooves in the drum.

Figure 1:
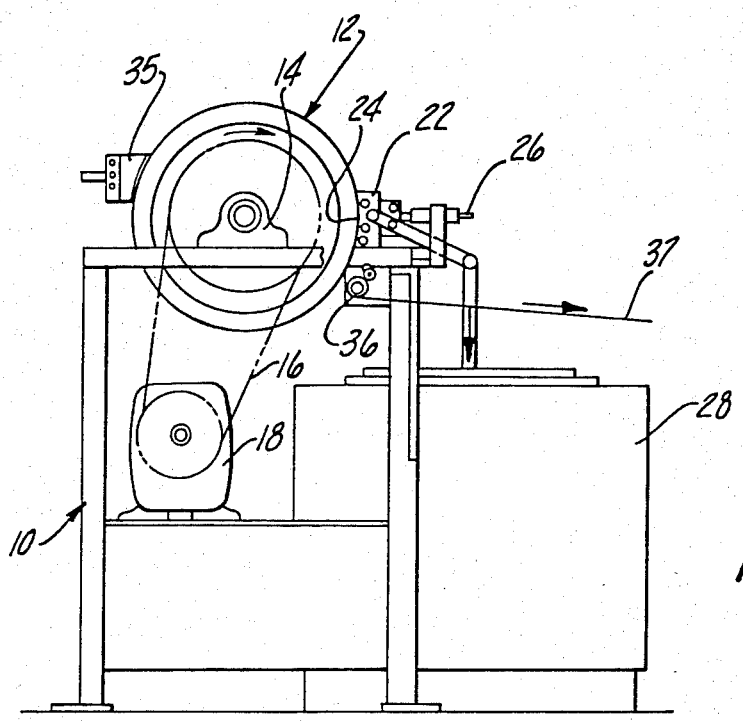
FIG. 1 is a side elevational view of a battery grid casting machine embodying the present invention.
Figure 2:
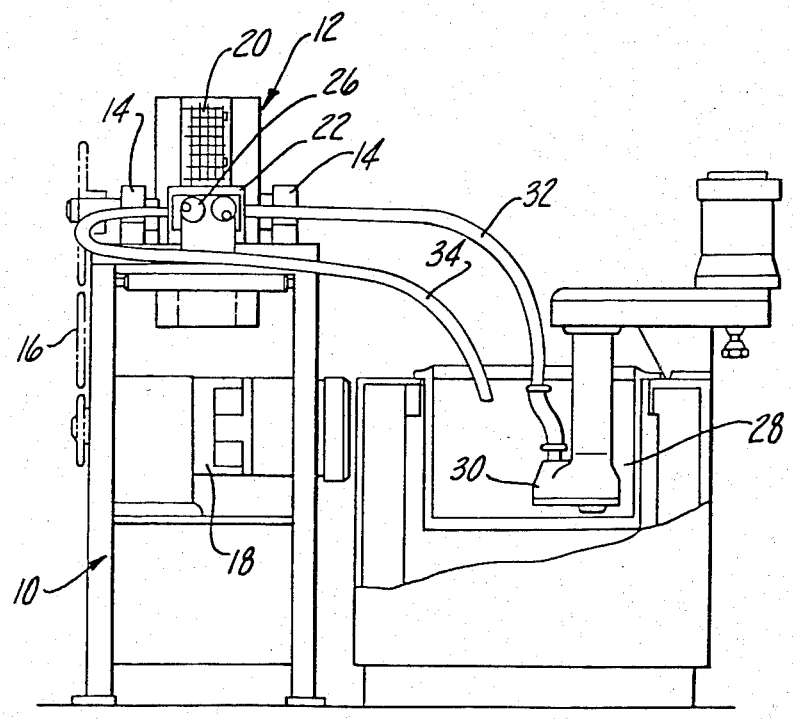
FIG. 2 is an end view of the machine illustrated in FIG. 1.
Figure 3:
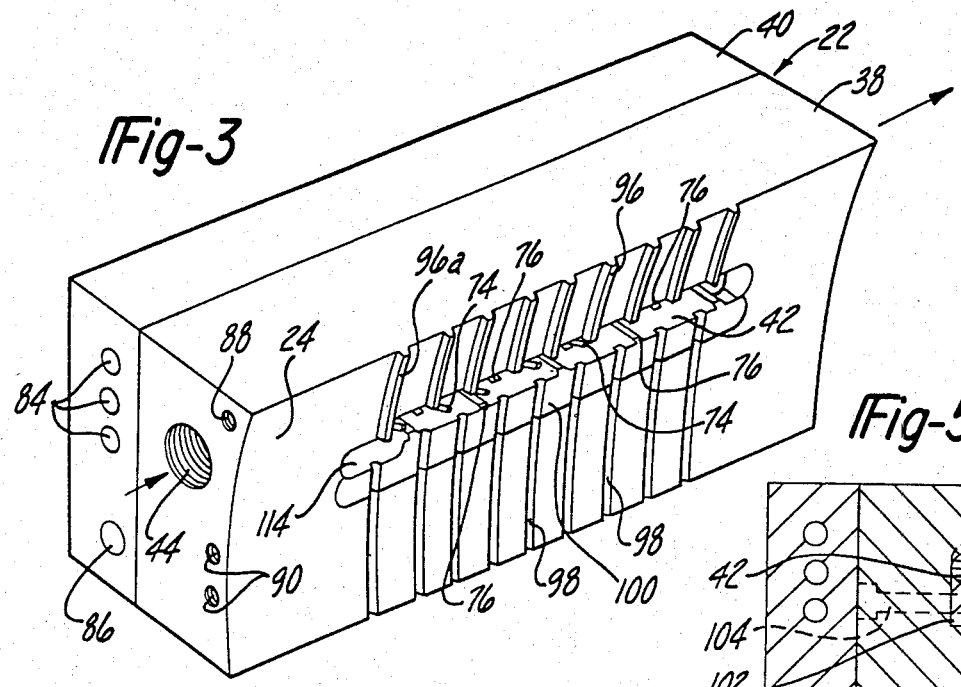
FIG. 3 is a perspective view of one form of shoe utilized on the machine.

The general construction of the machine of the present invention is illustrated in FIGS. 1 and 2. It consists of a frame 10 on which a battery grid casting drum 12 is journalled for rotation by pillow blocks 14. Drum 12 is rotated by means of a suitable belt or chain drive 16 from a variable speed motor 18. The outer peripheral surface of drum 12 has a cavity 20 conforming to the battery grid pattern machined therein. Against one side of drum 12 there is positioned a shoe 22 having an arcuate surface 24 which is maintained in pressuremating engagement with the outer peripheral surface of drum 12 by clamp screws 26. Molten lead under pressure is directed from a lead pot 28 by means of a motor-driven pump 30 through an inlet conduit 32 to shoe 22. The excess lead is returned to lead pot 28 through a return line 34. On the side of drum 12 generally opposite shoe 22 there is arranged a series of thermostatically controlled water spray nozzles 35 for maintaining the outer peripheral surface of the drum at a selected temperature, for example, at about 350° F. The connected cast grids are stripped from the drum around a roller 36 as a continuous web 37 which is thereafter pasted and severed into individual grids.

Important structural details of shoe 22 are illustrated in FIGS. 3 through 8. Shoe 22 includes an orifice block 38 and a heater block 40 secured against the outer face of block 38. Both of these blocks are formed of a metal, such as aluminum bronze, having high heat conductivity. Within block 38 there is formed an orifice slot 42 that extends lengthwise of the block, that is, in a direction axially of drum 12. At one end orifice slot 42 communicates with an inlet port 44 to which the conduit 32 is connected and at its other end slot 42 communicates with an outlet port 46 to which the return line 34 is connected. At the arcuate surface 24 on block 38 the orifice slot 42 is opened as at 48. Opening 48 is co-extensive in length with the grid cavity 20 in the outer periphery of drum 12. As a practical matter the inlet and outlet ports 44,46 are located in block 38 radially outwardly of orifice slot 42 and are therefore connected with the opposite ends of slot 42 by radially inwardly inclined passageways 49,50. Passageway 50 is preferably inclined at a greater angle to orifice slot 42 than passageway 49 and is preferably also of smaller cross section than passageway 49. The passageways 49,50 are so oriented and proportioned in size so that the lead directed into orifice slot 42 will be under superatmospheric pressure. Maintaining the lead in orifice slot 42 at superatmospheric pressure in the above manner or by other suitable means is essential in order to produce complete filling of the grooves in drum 12 which form the grid pattern.

Figure 11:
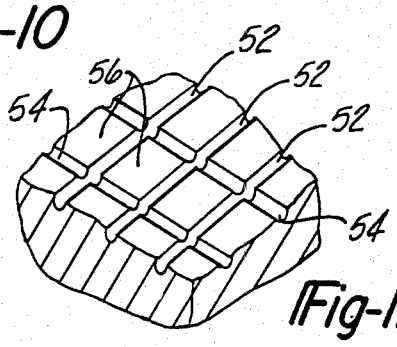
FIG. 11 is a fragmentary perspective view of a portion of the drum.

Referring now to FIG. 11, a fragmentary portion of the grid pattern on theperiphery of the drum is illustrated. This grid pattern consists of a plurality of grooves 52 which extend circumferentially around the drum and are spaced axially apart and a second plurality of grooves 54 which extend axially of the drum and are spaced apart circumferentially. Grooves 52 are preferably slightly deeper than grooves 54. The two sets of grooves intersect so as to define therebetween raised pads 56 which, in the finished battery grid 58 (FIG. 12), define the open spaces 60 between the intersecting wires 62,64. Wires 62 are formed by the lead which solidifies in grooves 52 and wires 64 are formed by the lead that solidifies in grooves 54.

Referring again to FIGS. 3 through 5 and 8, it has been learned that, unless the molten lead flowing through the orifice slot 42 from inlet port 44 to outlet port 46 is caused to follow an irregularly shaped path as distinguished from a straight lamellar flow, there is a tendency for the lead to solidify against the pads 56 and also within the grooves 52,54 in the area of the opening 48 of the orifice slot. Presumably this is due to the fact that, if the lead flows in a lamellar path lengthwise of the orifice slot, the lead directly adjacent the periphery of drum 12, which is at a temperature substantially below the solidification temperature of the lead, tends to remain substantially cooler than the lead flowing through the portion of the orifice slot spaced more remotely from the outer periphery of the drum. Then, as the drum rotates, this at least partially solidified lead is scrapped off of the pads 56 by the downstream edge 70 of the opening 48 and tends to accumulate as a sludge along this edge. Over a period of time the semisolid lead sludge may build up sufficiently to actually bridge circumferentially across the downstream edge 70 and the upstream edge 72 of opening 48. When this occurs the grooves 52,54 on the drum cannot be fed with molten lead directly overlying these grooves since they are blocked in a radial direction by the overlying sludge. Thus the radially blocked grooves can only be filled in a lateral direction from each side thereof by the transverse grooves 54. This frequently results in lack of fill or in a knitted junction rather than a homogeneous fused joint.

However, if the lead is caused to flow in an irregular path along the orifice slot 42, the above referred to problem is avoided. When the lead is caused to flow in an irregular path, lead which would normally tend to solidify against pads 56 is subjected to continual impingement by additional hot molten lead which thereby maintains the lead throughout the orifice slot 42 in a highly fluid condition. When the lead is caused to remain in a highly fluid condition substantially above its solidification temperature throughout the lateral extent of opening 48, grooves 52,54 are filled directly through opening 48 in a radial sense and the problem of incomplete filling and knitted joints is avoided.

Various structural means have been successfully employed for causing the lead to flow along the orifice slot in an irregular path. These means are designed so that the path is preferably an undulating path and preferably a path which undulates in a direction lengthwise of the orifice slot. This path may undulate radially, that is, toward and away from the periphery of the drum 12, or circumferentially of the drum. For example, the lead flowing through the orifice slot can be caused to follow a path which undulates in a radial direction by a plurality of pins 74 in block 38 which project radially into orifice slot 42. These pins 74 may extend into orifice slot 42 for a distance equal to about one-half or three-quarters of the radial depth of the slot and are preferably inclined at least slightly in the direction of lead flow. The inclination of these pins is desirable so they will not tend to act as dams in the orifice slot against which the lead can collect and solidify. Excellent results have also been obtained by forming a series of opposed radially extending projections 76 which are spaced apart along the downstream and upstream sides of the orifice slot. The projections 76 on one side of the slot are staggered intermediate the projections on the opposite side of the slot so that the flow path of the molten lead undulates back and forth across the opening 48 of the orifice slot.

It will be appreciated that the lead in the orifice slot adjacent the inlet end thereof tends to be at a higher temperature than the lead in the orifice slot adjacent its outlet. This is due to the fact that, while the lead introduced to shoe 22 may be at a temperature of about 800° or 900° F., the shoe itself is maintained at a substantially lower temperature, for example, 400° to 450° F., which is lower than the temperature at which the lead solidifies, that is, in the range of about 550° to 620° F. Therefore, the irregular flow path of the lead through the orifice slot is more critical adjacent the outlet port than the inlet port. For this reason, it is more important to utilize pins 74 or projections 76 adjacent the outlet than the inlet. In one shoe that has been operated very successfully where the opening 48 of the orifice slot was about $\frac{3}{8}$" wide and about 6" long, five regularly-spaced projections 76 on each side of the orifice slot, each extending inwardly about $\frac{1}{8}$", were employed and only a single pin 74 was utilized adjacent the outlet end of the orifice slot.

Figure 8:
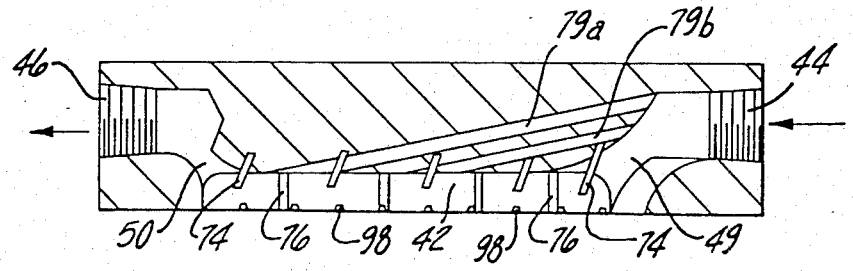
FIG. 8 is a sectional view along the line 8—8 in FIG. 4 and showing a slightly modified form of shoe.

In some instances a more substantially uniform temperature of the molten lead along the extent of the orifice slot is achieved by directing the hot molten lead from the inlet passageway 49 directly to intermediate sections of the orifice slot as by one or more passageways extending through the shoe from the inlet passageway to a selected section of the orifice slot. Two such passageways, designated **79*a*,79*b*, are illustrated in FIG. 8. When such passageways are provided, less hot lead is directed to the orifice slot adjacent its inlet and, as a consequence, the lead introduced to the intermediate section of the orifice slot is hotter than it would otherwise be if introduced at the inlet end of the slot. The cross sectional areas of passageways 79*a*,79*b* are determined to produce the desired amount of flow of lead to the various sections of slot 42**.

Figure 9:
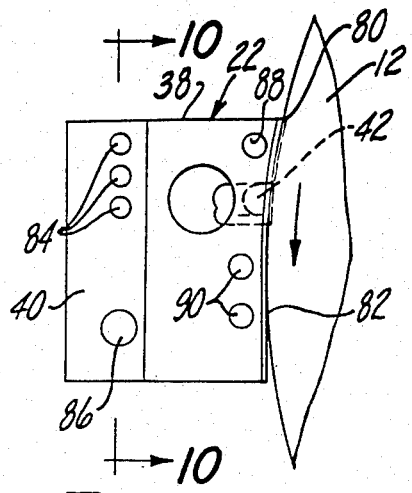
FIG. 9 is an end view of the shoe and the adjacent portion of the drum.
Figure 10:
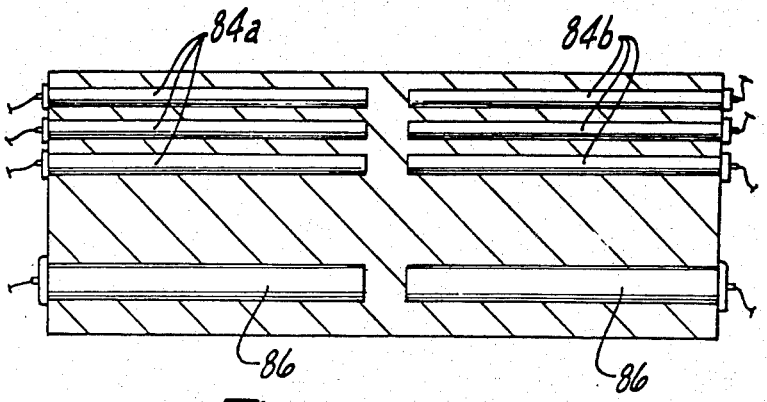
FIG. 10 is a sectional view along the line 10—10 in FIG. 9.

In a battery grid casting machine of the type involved it is necessary to maintain the drum 12 at a relatively low temperature below the melting temperature of the lead alloy, for example, at about 350° F., so that the lead will solidify in the battery grid cavity 20 on the drum substantially immediately after that portion of the grid cavity advances beyond the opening 48 of the orifice slot. For example, as shown in FIG. 9, the arcuate surface 24 on shoe 22 conforms with the cylindrical surface of drum 12 from the upstream or top side of the shoe along the line 80 in a downwardly direction past the orifice slot 42 and for a short distance therebeyond as at 82. The lead wires in the grooves 52,54 of the grid cavity must solidify by the time they reach the location 82. On the other hand, for the reasons previously mentioned, it is important to maintain the lead in the grid cavity in the area of theorifice slot very fluid. Therefore, a rather delicate balance of temperatures is required between the drum 12 and shoe 22. The shoe itself is, of course, heated by the high temperature molten lead flowing therethrough. In order to maintain the shoe at a proper temperature and to prevent it from warping in an axial direction, a plurality of heating elements 84 extend into block 40 from opposite ends thereof. Since shoe 22 tends to be hotter at the inlet end of orifice slot 42, the heating elements **84*a* on the outlet side of the shoe are of a higher wattage than the heating elements 84*b* on the inlet end of the shoe. This tends to maintain the shoe at a more uniform temperature throughout its length. Additional larger heating elements 86 are utilized in block 40** for start up and for melting all of the lead in the shoe so as to permit it to run out at the end of a production run.

Figure 6:
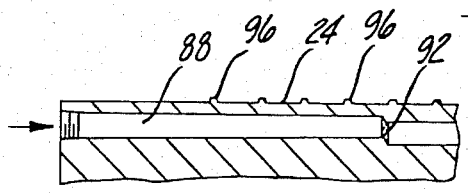
FIG. 6 is a sectional view along the line 6—6 in FIG. 4.
Figure 7:
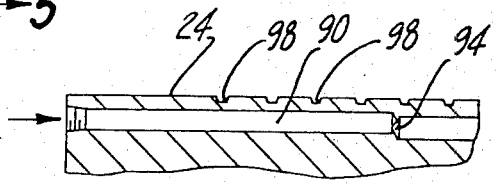
FIG. 7 is a sectional view along the line 7—7 in FIG. 4.

It is also necessary to cool shoe 22 adjacent the surface thereof against the drum so as to prevent overheating of the shoe. Since the battery grid solidifies after it has past orifice slot 42, greater cooling on the downstream side of the orifice slot is required than on the upstream side thereof. Accordingly, upstream of the orifice slot 42 block 38 is formed with a water coolant passageway 88 and on the downstream side of orifice slot 42 two coolant passageways 90 extend through block 38. Since, as pointed out above, the end portion of shoe 22 adjacent the inlet of orifice slot 42 tends to be hotter than the end portion adjacent the outlet of orifice slot 42, the coolant passageways 88,90 are so formed as to provide a greater cooling effect at the inner face of the shoe adjacent the inlet end than at the outlet end. For example, as shown in FIG. 6, passageway 88 has an offset 92 at generally the axially central portion of the block so that the portion of pas sagewy 88 adjacent the inlet side of the block is spaced closer to the arcuate surface 24 than the portion of the passageway adjacent the outlet end of the block. As shown in FIG. 7, the same arrangement is utilized with respect to the coolant passageways 90, each of which has a radial offset 94 at generally the axial central portion of the shoe.

From the structure thus far described it will be apparent that the portion of the shoe upstream from orifice slot 42 and adjacent the surface 24 thereof should be maintained at a higher temperature than the portion of the shoe downstream from the orifice slot. Since the lead flowing through the orifice slot is under superatmospheric pressure, it is important to prevent the molten lead from flowing into the circumferentially extending grooves 52 on the drum in an upwardly or upstream direction. One way of accomplishing this is to provide the curved surface 24 of shoe 22 with a series of circumferentially extending ribs 96 which mate and interfit with grooves 52 in the drum. Thus, those portions of groove 52 which are upstream from the orifice slot 42 are blocked by ribs 96 and are unable to be filled with molten lead until they advance into registry with the opening 48 of the orifice slot.

An alternate method of preventing the molten lead from flowing in an upstream direction on the drum is illustrated in FIG. 21. In this arrangement the upstream side of slot 42 is provided with short, shallow grooves 95 are located sufficiently close to coolant passageway 88 so that the lead will solidify therein and also in an adjacent short section of the registering groove 62 to form a slug 97 of lead which seals grooves 62 in a direction upstream from the orifice slot.

As is well known by anyone familiar with the battery grid art, after a battery grid is cast, it must be pasted or filled with a lead oxide compound. To facilitate the application of paste as a uniform layer to both faces of the battery grid, it is desirable to have the wires in one direction project outwardly beyond the wires extending in the opposite direction on both faces of the grid. In the machine of the present invention this is facilitated by forming grooves 98 in face 24 of shoe 22 which register with grooves 52 on drum 12 and extend downwardly or downstream from the downstream edge 70 of orifice slot 42. Thus the molten lead in orifice slot 42 fills both grooves 52 and 98 as the drum rotates past the orifice slot. Therefore, as shown in FIG. 12*a*, the wires 62 project beyond the wires 64 on both sides of the battery grid. It is not essential that the grooves 98 in the shoe register with the grooves 52 in the drum. It is possible to obtain an even better interlock between the paste layer and the grid wires when the grooves in the shoe are offset slightly laterally from the grooves in the drum as shown in FIG. 22. In this case the wire sections 99 on one face of the grid are offset from the wire sections 62 on the opposite face of the grid. The resulting stepped configuration tends to better inhibit separation of the paste layer from the grid.

As mentioned previously, the curved surface 24 is in close fitting engagement with the outer periphery of drum 12 down to the location 82 which is located downstream from orifice slot 42, but located upstream from the lower end of the shoe. It is desirable to have a minimum area of contact between the shoe and the drum, not only from the standpoint of reducing friction, but also because of the inability to maintain large surface areas of the drum and shoe in perfect mating contact since these two members are operating at substantially different temperatures. On the other hand, the area of contact between the shoe and the drum on the downstream side of orifice slot 42 must be of sufficient circumferential extent to permit substantial solidification of the battery grid before it is stripped from the drum. Wc have found that the portion of the arcuate surface 24 downstream from the orifice slot 42 can be maintained at a temperature which will facilitate rapid solidification of the battery grid by employing an insert 100 in the face 24 of the shoe 22 directly adjacent the downstream side of orifice slot 42. The insert 100, which is co-extensive in length with the orifice slot 42, is formed of a metal which has good wear resistant properties at high temperatures and, at the same time, which has a relatively low heat conductivity relative to the material from which shoe 22 is formed. We have found that by forming insert 100 from steel, excellent results are obtained. A steel insert at this location on the shoe forms a heat barrier between the molten lead in orifice slot 42 and the portion of the shoe downstream from the insert. At the same time, steel has much better wear resistance with respect to the cast iron drum than does the aluminum-bronze from which the shoe is made. Since the thermal rate of expansion of steel is different from aluminum-bronze, insert 100 should be slightly undersized relative to the cavity 102 in which the insert is seated. The insert may be locked in place by means of a plurality of screws 104 extending inwardly from the outer face of block 38.

To obtain maximum wear resistance of the shoe, an insert such as illustrated at 106 in FIGS. 19 and 20 can be employed. Insert 106 extends completely around the orifice slot and also behind the orifice slot. Thus, when an insert such as illustrated at 106 is employed, the shoe is formed with a cavity adapted to receive the entire insert and the orifice slot is formed within the insert which is open at each end so as to communicate with the inlet and outlet ports in the shoe. Since a heat barrier in the shoe on the upstream side of the orifice slot is not required, the portion of the insert on the upstream side of the slot is narrower than the portion on the downstream side.

Most battery grids are provided at one corner thereof with a lug such as shown at 110 in FIG. 12. Lug 110 is normally located directly adjacent the line of severance 111 between successive grids. When a plurality of grids are assembled within a battery case, the lugs 110 are soldered together and electrically connected to the battery terminals. It is therefore important that the junction between lug 110 and the adjacent wires 62,64 is defined by a homogeneous fused joint. If these junctions are in the nature of knitted joints, that is, a seam in the solidified lead, the structural rigidity of the grid is impaired and its current carrying capacity is seriously diminished.

Heretofore, a serious problem has arisen in connection with the casting of lug 110 in a manner as to avoid seams at the joints between this lug and the adjacent wires. The nature of this problem is illustrated in FIGS. 13 and 14. In prior art machines the equivalent of the orifice slot 42, designated 42*a* in FIGS. 13 and 14, has been essentially straight throughout its length. With such an arrangement as soon as the rectangularly shaped lug cavity 112 in the drum advances into registry with the upstream side of the orifice slot 42*a*, substantially the entire cavity 112 fills with molten lead which also flows into the grooves 54 in a lateral inward direction from cavity 112. Then, as the drum continues to rotate and these partially filled grooves 54 advance into registration with the orifice slot, the lead therein becomes partially solidified since they were previously fed from cavity 112. A seam or a knit in the wire of the grid frequently results.

With the machine of the present invention this problem is overcome by offsetting the portion of the opening 48 which registers circumferentially with cavity 112 in a downstream direction. The result of this offset opening is illustrated schematically in FIGS. 15 through 17. In the present machine cavity 112 is formed at that side of the drum which corresponds to the inlet side of shoe 22. The portion 114 of the opening 48 of orifice slot 42 which registers with cavity 112 is offset in a downstream direction relative to the remainder of opening 48. It will be observed from FIG. 4 that the endmost rib 96*a* extends in a downstream direction to the upstream side of the offset portion 114. Thus, as the drum 12 rotates (in a downward direction as viewed in FIGS. 15 through 17 and in a clockwise direction as viewed in FIG. 1), the lowermost groove 54 that connects with lug 112 registers with opening 48 before lug 112 advances into registration with the offset opening 114. Thus, one or more grooves 54 fill with molten lead before the molten lead flows into lug cavity 112. Since the endmost rib 96*a* extends to the offset between opening 114 and opening 48, it follows that the molten lead in the groove sections which register with opening 48 will maintain the downstream end of rib 96*a* in a highly heated condition. Therefore, when lug cavity 112 advances into registration with the offset opening 114 (FIG. 16), molten lead will flow into cavity 112 and thus impart heat to the end portion of endmost rib 96*a* from the opposite side thereof.

With this arrangement, when the succeeding grooves 54 advance into registration with the opening 114, the lead in these grooves will form a good fused bond with the lead in cavity 112 since the end portion of the endmost rib 96*a* has been maintained in a highly heated condition.

Figure 5:
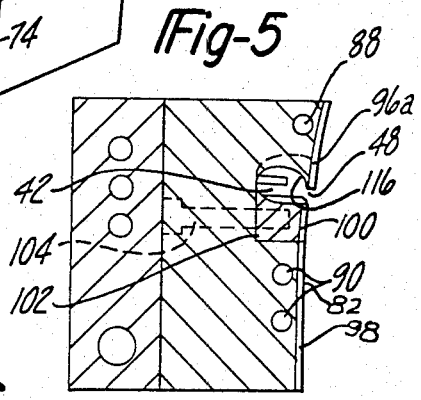
FIG. 5 is a sectional view along the line 5—5 in FIG. 4.
Figure 4:
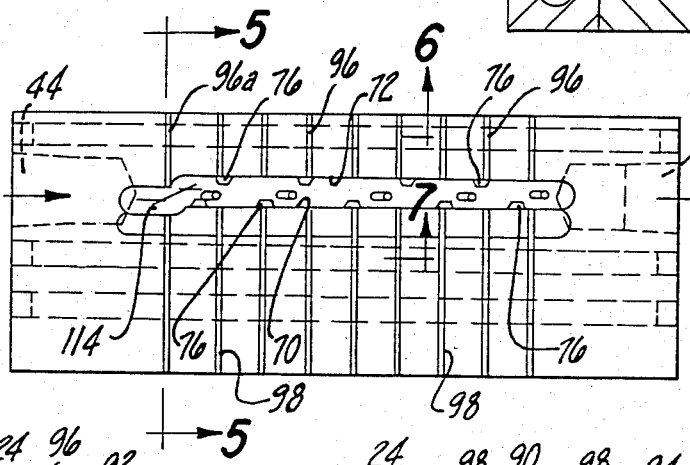
FIG. 4 is a plan view of the face of the shoe adjacent the drum.

The heat imparted to the end portion of the endmost rib 96*a* can be further enhanced by undercutting the orifice slot 42 directly below the end portion of this rib. Thus, as shown in FIGS. 5 and 20, the orifice slot is undercut as at 116 so that the end of the endmost rib 96*a* overlies a relatively thin portion of the shoe which readily transmits heat from the molten lead to this rib. The width of the offset opening 114 is preferably narrower in a circumferential direction than opening 48. By making the offset opening 114 smaller than the remainder of the opening the tendency to produce a hot spot at this section of the grid is reduced and thus insures the desired rapid solidification as soon as this portion of the grid advances beyond the orifice slot opening.

We claim:

1. In a machine for continuously casting battery grids, the machine including a drum adapted to be rotated in one direction and having on its outer peripheral surface a cavity which defines the pattern of the battery grid, said grid pattern comprising two sets of intersecting grooves, said grooves defining pads therebetween which form the outer peripheral surface of the drum and which define the open spaces between the wires of the cast battery grid, said machine including a shoe having an arcuate surface in mating engagement with said pads around an arcuate segment of the drum, said shoe having an orifice slot therein which is axially co-extensive with said cavity and which is open at the portion of said arcuate surface that is intermediate the circumferentially opposite ends of the shoe, said shoe having an inlet and an outlet communicating with axially spaced portions of the orifice slot, said machine also including means for directing molten lead at superatmospheric pressure to said inlet in an amount in excess of that required to progressively fill the grid cavity as it rotates past the opening in the orifice slot so that the excess is discharged through said outlet, that improvement which comprises means in the orifice slot for reducing the tendency for the lead to partially solidify and bridge circumferentially across the upstream and downstream sides of the opening in the orifice slot, said means comprising obstructions spaced lengthwise along the orifice slot which cause the lead flowing from said inlet to said outlet to follow an irregular undulating path across the outer peripheral surface of the drum.

2. The improvement called for in claim 1 wherein said means causes the lead to flow in a radially undulating path toward and away from the outer peripheral surface of the drum.

3. The improvement called for in claim 1 wherein said means causes the lead to flow in a circumferentially undulating path across the outer peripheral surface of the drum.

4. The improvement called for in claim 1 wherein said means for causing said lead to flow in said undulating path comprises a plurality of projections in said orifice slot spaced apart lengthwise of the slot.

5. The improvement called for in claim 4 wherein said projections extend radially inwardly toward said drum.

6. The improvement called for in claim 5 wherein said projections comprise a plurality of pins in the orifice slot.

7. The improvement called for in claim 6 wherein said pins are inclined axially in the direction of flow of lead in the orifice slot from the inlet to the outlet.

8. The improvement called for in claim 7 wherein said pins project toward the drum for between about $\frac{1}{2}$ to $\frac{3}{4}$ the radial depth of the orifice slot.

9. The improvement called for in claim 4 wherein said projections extend circumferentially toward each other from opposite sides of the orifice slot, the projections on one side being staggered axially with respect to the projections on the other side of the slot.

10. In a method for continuously casting battery grids, by using a machine which includes a drum adapted to be rotated in one direction and having on its outer peripheral surface a cavity which defines the pattern of the battery grid, said grid pattern comprising two sets of intersecting grooves, said grooves defining pads therebetween which form the outer peripheral surface of the drum and which define the open spaces between the wires of the cast battery grid, said machine including a shoe having an arcuate surface in mating engagement with said pads around an arcuate segment of the drum, said shoe having an orifice slot therein which is axially co-extensive with said cavity and which is open at a portion of said arcuate surface that is intermediate the circumferentially opposite ends of the shoe, said shoe having an inlet and an outlet communicating with axially spaced portions of the orifice slot, said machine also including means for directing molten lead at superatmospheric pressure to said inlet in an amount in excess of that required to progressively fill the grid cavity as it rotates past the opening in the orifice slot so that the excess is discharged through said outlet, the method of preventing lead sludge from circumferentially bridging across the upstream and downstream edges of the opening of the orifice slot which comprises providing obstructions spaced lengthwise along the orifice slot for causing the molten lead to flow from said inlet to said outlet in an undulating path along said opening.

11. The method called for in claim 10 wherein said obstructions cause the lead to flow in a radially undulating path toward and away from said pads and grooves on the drum so that the lead which tends to solidify on said pads is subjected to repeated, somewhat radial, impingement of additional molten lead flowing from said inlet to said outlet.

12. The method called for in claim 10 wherein said lead is caused to flow from said inlet to said outlet in a path which undulates circumferentially across the orifice slot.

13. The method called for in claim 10 wherein the molten lead is caused to flow from the inlet to the outlet of the orifice slot in a path which undulates in directions both radially and circumferentially across the opening of the orifice slot.

14. The method called for in claim 10 wherein the molten lead is caused to flow from the inlet to the outlet in a path which undulates circumferentially across the opening of the orifice slot and adjacent the outlet end of the orifice slot the lead is also caused to flow in a direction generally radially toward the outer peripheral surface of the drum.

* * * * *